US006852143B2

(12) United States Patent
Hayashi et al.

(10) Patent No.: US 6,852,143 B2
(45) Date of Patent: Feb. 8, 2005

(54) TURBO COMPONENT FOR TURBOCHARGER

(75) Inventors: Koichiro Hayashi, Matsudo (JP); Michiharu Mogami, Kashiwa (JP)

(73) Assignee: Hitachi Powdered Metals Co., Ltd., Matsudo (JP)

( * ) Notice: Subject to any disclaimer, the term of this patent is extended or adjusted under 35 U.S.C. 154(b) by 31 days.

(21) Appl. No.: 10/046,770

(22) Filed: Jan. 17, 2002

(65) Prior Publication Data

US 2002/0139448 A1 Oct. 3, 2002

(30) Foreign Application Priority Data

Jan. 31, 2001 (JP) ..... 2001-023242

(51) Int. Cl.[7] ..... C22C 38/22; C22C 38/02
(52) U.S. Cl. ..... 75/246; 75/240
(58) Field of Search ..... 75/240, 246, 238, 75/245; 148/325, 419, 442, 324; 420/67, 42, 583

(56) References Cited

U.S. PATENT DOCUMENTS 4,345,943 A * 8/1982 Takahashi et al. ..... 75/238

FOREIGN PATENT DOCUMENTS

JP 359016952 * 1/1984 ..... 420/42

* cited by examiner

*Primary Examiner*—Deborah Yee
(74) *Attorney, Agent, or Firm*—Oliff & Berridge, PLC

(57) ABSTRACT

A turbo component for a turbocharger in which heat resistance, corrosion resistance, and wear resistance is superior, and in which the cost is further lowered, is provided. In the turbo component, the overall composition is, in ratio by mass, Cr: 23.8 to 44.3%, Mo: 1.0 to 3.0%, Si: 1.0 to 3.0%, P: 0.1 to 1.0%, C: 1.0 to 3.0%, and the balance of Fe and inevitable impurities, and carbide is dispersed in the matrix at a density ratio of 95% or more.

2 Claims, 5 Drawing Sheets

TURBO COMPONENT FOR TURBOCHARGER

BACKGROUND OF THE INVENTION

The present invention relates to a turbo component for a turbocharger, and more particularly, the present invention relates to a component suitable for a nozzle body which requires heat resistance, corrosion resistance, and wear resistance.

Generally, in a turbocharger attached to an internal combustion engine, a turbine is rotatably supported on a turbine housing connected to an exhaust manifold of the internal combustion engine, and several nozzle vanes are rotatably supported so as to surround an external surface of the turbine. Exhaust gas which flowed into the turbine housing flows into the turbine from the outside and is exhausted in an axial direction, while rotating the turbine in this process. By rotation of a compressor mounted on the same shaft as that of the turbine at the opposite side, air supplied into the internal combustion engine is compressed.

Herein, the nozzle vanes are rotatably supported on a ring-shaped component as it is called a nozzle body or mount nozzle. A shaft of the nozzle vanes penetrates through the nozzle body, and is connected to a link mechanism. As the link mechanism is driven, the nozzle vanes rotate, and the opening degree of a flow passage of exhaust gas flowing into the turbine is adjusted. The present invention relates to a turbo component provided in the turbine housing, such as a nozzle body (mount nozzle) or a plate nozzle mounted thereon. That is, the present invention relates to a turbo component which contacts exhaust gas and also contacts the other driving members such as nozzle vanes.

Such a turbo component for a turbocharger contacts exhaust gas, which is a high temperature corrosive gas, and is hence required to have heat resistance and corrosion resistance, and is also required to have wear resistance because it slides with nozzle vanes. Hitherto, therefore, the component was made of high Cr cast steel, or SCH22 grade steel specified in the Japanese Industrial Standard with Cr surface treatment to enhance corrosion resistance.

However, these materials are not only poor in machinability but are also expensive and production costs of the turbo component are high, and therefore, there was a problem in that recent requirements for lower costs were not satisfied.

SUMMARY OF THE INVENTION

It is therefore an object of the present invention to provide a turbo component for a turbocharger (hereinafter called a turbo component) in which heat resistance, corrosion resistance and wear resistance are superior and in which the cost is low.

A turbo component of the present invention is characterized in having an overall composition, in ratio by mass, of Cr: 23.8 to 44.3%, Mo: 1.0 to 3.0%, Si: 1.0 to 3.0%, P: 0.1 to 1.0%, C: 1.0 to 3.0%, and the balance of Fe and inevitable impurities, and that carbides are dispersed in the matrix at a density ratio of 95% or more.

A production method for a turbo component of the present invention comprises of using mixed powder having 1.0 to 3.3 mass % of Fe—P powder including P: 10 to 30 mass %, and 0.5 to 1.5 mass % of graphite powder, added to Fe alloy powder comprising, in ratio by mass, Cr: 25 to 45%, Mo: 1 to 3%, Si: 1 to 3%, C: 0.5 to 1.5%, and the balance of Fe and inevitable impurities; forming the mixed powder; and sintering.

In the above production method, in order to generate a liquid phase when sintering by lowering the liquid phase temperature and to obtain a dense sintered body, P and C are used in a form of Fe—P powder and graphite powder, and the Cr, Mo, and Si are used in a form of Fe alloy powder, and they are mixed and used as mixed powder. The basis for the numerical limitations of the above values is explained hereinafter with the effect of the present invention. In the following explanation, percentage signifies percentage by mass.

Cr:

Cr contributes to enhancement of heat resistance and corrosion resistance of the matrix, and it is also bonded with C to form carbide to enhance the wear resistance. In high Cr cast iron with the same Cr content as that of the present invention, Cr carbide precipitates in the grain boundary and does not contribute much to enhancement of wear resistance, but in the present invention, since Cr is added in a form of Fe alloy powder, fine granular Cr carbide disperses in the matrix, and a metallographic structure having sufficient wear resistance and oxidation resistance is obtained. In order to exhibit the effect of Cr uniformly in the matrix, Cr is added in the form of Fe alloy powder. Herein, if the Cr content in Fe alloy powder is less than 25%, precipitation of Cr carbide is insufficient and wear resistance is not sufficient, and also the heat resistance and corrosion resistance of the matrix are lowered. In contrast, if the Cr content exceeds 45%, compacting property of powder is notably deteriorated. Hence, the Cr content in the Fe alloy powder is specified to be in a range of 25 to 45%.

Mo:

Mo contributes to enhancement of heat resistance and corrosion resistance of the matrix, and it is also bonded with C to form carbide to enhance wear resistance. In the same way as Cr, Mo is also added in a form of Fe alloy powder in order to exhibit its effect uniformly in the matrix. If the Mo content in the Fe alloy powder is less than 1%, the effect for improving heat resistance and corrosion resistance of the matrix is poor. In contrast, even when it is added at more than 3%, the effect is not substantially improved. Hence, the Mo content in Fe alloy powder is specified to be in a range of 1 to 3%.

Si:

Since Fe alloy powder has a high content of Cr which is easily oxidized, it is effective to add Si as a deoxidant when producing Fe alloy powder. Also, Si enhances sintering properties. If the Si content in the Fe alloy powder is less than 1%, its effect is poor, but when it exceeds 3%, the Fe alloy powder is too hard, and the compacting property is notably deteriorated. Hence, the Si content in the Fe alloy powder is specified to be in a range of 1 to 3%.

P:

Together with C, P forms an Fe—P—C liquid phase when sintering, and promotes dense structure of the sintered body, and a density ratio of 95% or more can be achieved. Also in order to promote liquid phase forming when sintering and forming dense structure, P is added in a form of Fe—P powder, that is, Fe—P alloy powder. If the P content in the Fe—P powder is less than 10%, a sufficient liquid phase is not formed, and it does not contribute to formation of a dense sintered body. In contrast, when it exceeds 30%, the Fe—P powder becomes hard, and the compacting property is notably deteriorated.

If addition of the Fe—P power in the mixed powder is less than 1.0%, the liquid phase generation amount is insufficient, and a sufficiently dense structure is not obtained, and the density ratio becomes lower than 95%. In contrast, if the P content in the overall composition exceeds 1.0%, the matrix becomes brittle and is lowered in corrosion resistance, and hence the upper limit of the addition amount of the Fe—P powder in the mixed powder is 3.3%.

Hence, the P content in the overall composition is 0.1 to 1.0%, and the Fe—P powder with a P content of 10 to 30% is used, and the Fe—P powder is added in the mixed powder in a range of 1.0 to 3.3%.

C:

C lowers the liquid phase forming temperature and hence generates an Fe—P—C liquid phase when sintering, and further promotes a dense sintered structure and forms carbides with Cr and Mo, thereby contributing to enhancement of wear resistance. If the Cr content in overall composition is less than 1%, these effects are insufficient. In contrast, when it exceeds 3%, the matrix becomes brittle and precipitation of carbides increases, thereby promoting wear of counterpart components such as vanes, and decreasing the Cr content in the matrix, so that heat resistance and corrosion resistance may also be lowered. Hence, the C content in the overall composition is specified to be in a range of 1.0 to 3.0%.

However, when the total amount of C is given in the form of graphite powder, the Fe alloy powder becomes a solid solution in which Cr and Mo are dissolved in the Fe matrix, and the hardness of the Fe alloy powder is excessive, and the compacting property is deteriorated. Excessive addition of graphite powder also deteriorates the compacting property of the mixed powder. Hence, a part of C is added in the form of Fe alloy powder, and the remaining C is added in the form of graphite powder. When a part of C is added in the form of Fe alloy powder, Cr and Mo in the Fe alloy powder precipitate in the Fe alloy powder as carbide, and the solid solution amount of Cr and Mo in the matrix of the Fe alloy powder decreases, so that the compacting property of the Fe alloy powder is improved. Furthermore, the compacting property of the mixed powder is also improved by adding the remaining C in the form of graphite powder. At this time, if the C content in the Fe alloy powder is less than 0.5%, the solid solution amount of Cr and Mo in the Fe matrix is increased, and the Fe alloy powder is hard and is poor in compacting property. In contrast, when it exceeds 1.5%, the precipitating amount of carbide in the Fe alloy powder increases, and the hardness of the Fe alloy powder becomes too high; hence the C content in the Fe alloy powder is specified to be in a range of 0.5 to 1.5%. The remaining 0.5 to 1.5% is added to the mixed powder as graphite powder.

Hence, the Fe alloy powder is composed of Cr: 25 to 45%, Mo: 1 to 3%, Si: 1 to 3%, C: 0.5 to 1.0%, and balance: Fe and inevitable impurities, and the Fe—P alloy powder is composed of P: 10 to 30%, and balance: Fe and inevitable impurities, and the mixed powder is formed by adding 1.0 to 3.3% of Fe—P powder and 0.5 to 1.5% of graphite powder to the Fe alloy powder.

Using the mixed power having such a composition, by forming and sintering using an ordinary powder metallurgical technique, it is possible to easily obtain a turbo component in which the overall composition is, in ratio by mass, Cr: 23.8 to 44.3%, Mo: 1.0 to 3.0%, Si: 1.0 to 3.0%, P: 0.1 to 1.0%, C: 1.0 to 3.0%, and the balance of Fe and inevitable impurities and carbide is dispersed in the matrix at a density ratio of 95% or more.

In particular, in the turbo component of the present invention, since the density ratio is 95% or more, oxidation or pitting in pores can be suppressed, and corrosion resistance is substantially improved. Furthermore, wear resistance and oxidation resistance can be improved by dispersing fine granular Cr carbide in the matrix.

BEST MODE FOR CARRYING OUT THE INVENTION

Figure 1:
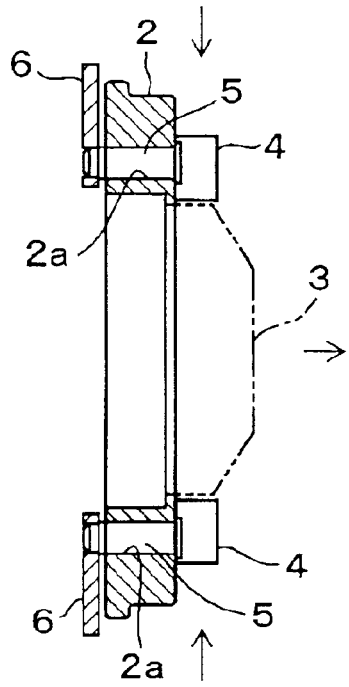
FIG. 1 shows a side sectional view of a turbo component according to an embodiment of the present invention.
Figure 2:
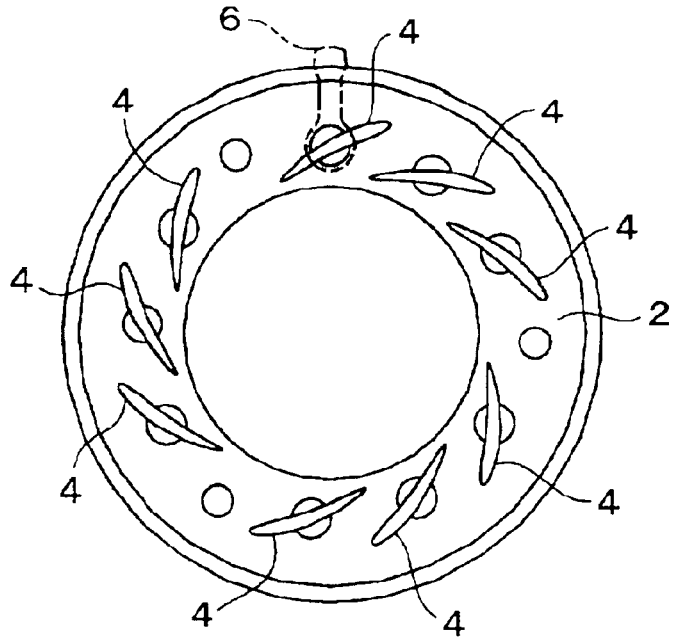
FIG. 2 shows a plan view of a turbo component according to an embodiment of the present invention.

FIG. 1 and FIG. 2 are drawings showing embodiments of the present invention. FIG. 1 shows a side sectional view of a part of turbocharger for internal combustion engine, and in the figures, reference numeral 2 indicates a nozzle body. In the center of the nozzle body 2, a turbine 3 is rotatably supported by a bearing not shown. At the opposite side end of the turbine 3, a compressor, not shown, is connected.

In this configuration, the nozzle body 2 is a turbo component of the embodiment. As shown in FIG. 2, the nozzle body 2 is shaped like a ring, and several bearing holes 2*a* are formed on the outside thereof. In the bearing holes 2*a*, shafts 5 of nozzle vanes 4 are rotatably supported. At the opposite side end of the nozzle vanes 4 of the shafts 5, links 6 are fixed (only one is shown in FIG. 2). The nozzle vanes 4 are rotated by uniformly driving the links 6, and the flow rate of exhaust gas flowing into the turbine 3 from the outside is thereby adjusted. The turbo components of the present invention include not only the nozzle body 2, but also other parts to be mounted thereon, such as a plate nozzle, and they are composed of the sintered alloy as described above.

EXAMPLES

In the following, embodiments of the present invention are explained in detail.

Fe alloy powder, Fe-20%P powder, and graphite powder, having compositions shown in Table 1, were prepared, and these powders were mixed at the rates specified in Table 1. Overall compositions of the obtained mixed powders are shown in Table 1. Using these mixed powders, rings were formed with outside diameter of 30 mm, inside diameter of 15 mm, and height of 10 mm at a forming pressure of 6 ton/cm$^2$, and samples Nos. 1 to 13 were formed by sintering at 1200° C. in a vacuum for 60 minutes. As a conventional material, a molten material of high Cr cast steel having the composition shown in Table 1 was formed in the same ring shape. These samples were heated to a temperature range of 750 to 900° C. in air for 100 hours, and amount of weight increase after heating was measured. The results are shown in FIGS. 3 to 6.

TABLE 1

| Sample No. | Mixing ratio, mass % | | | | | | | | Overall composition, mass % | | | | | | Increase of weight by oxidation (atm. × 100 h) mg | | | Remarks |
|---|---|---|---|---|---|---|---|---|---|---|---|---|---|---|---|---|---|---|
| | Fe alloy powder | | | | | | Fe-20P powder | Graphite powder | | | | | | | | | | |
| | Addition amount | Fe | Cr | Mo | Si | C | addition amount | addition amount | Fe | Cr | Mo | Si | P | C | 750 ° C. | 800 ° C. | 900 ° C. | |
| 1 | Balance | Balance | 30.0 | 2.0 | 2.0 | 1.0 | 0.0 | 1.0 | Balance | 29.7 | 2.0 | 2.0 | 0.0 | 2.0 | 10 | 15 | 20 | Outside lower limit of P content |
| 2 | Balance | Balance | 30.0 | 2.0 | 2.0 | 1.0 | 0.5 | 1.0 | Balance | 29.7 | 2.0 | 2.0 | 0.1 | 2.0 | 0 | 1 | 3 | |
| 3 | Balance | Balance | 30.0 | 2.0 | 2.0 | 1.0 | 2.5 | 1.0 | Balance | 29.0 | 1.9 | 1.9 | 0.5 | 2.0 | 1 | 3 | 5 | |
| 4 | Balance | Balance | 30.0 | 2.0 | 2.0 | 1.0 | 5.0 | 1.0 | Balance | 28.2 | 1.9 | 1.9 | 1.0 | 1.9 | 2 | 5 | 7 | |
| 5 | Balance | Balance | 30.0 | 2.0 | 2.0 | 1.0 | 7.5 | 1.0 | Balance | 27.5 | 1.8 | 1.8 | 1.5 | 1.9 | 12 | 17 | 23 | Outside upper limit of P content |
| 6 | Balance | Balance | 30.0 | 2.0 | 2.0 | 1.0 | 0.5 | 0.0 | Balance | 29.9 | 2.0 | 2.0 | 0.5 | 1.0 | 12 | 17 | 22 | Outside lower limit of graphite content |
| 7 | Balance | Balance | 30.0 | 2.0 | 2.0 | 1.0 | 0.5 | 0.5 | Balance | 29.7 | 2.0 | 2.0 | 0.5 | 1.5 | 5 | 7 | 10 | |
| 8 | Balance | Balance | 30.0 | 2.0 | 2.0 | 1.0 | 0.5 | 1.5 | Balance | 29.4 | 2.0 | 2.0 | 0.5 | 2.5 | 3 | 5 | 7 | |
| 9 | Balance | Balance | 30.0 | 2.0 | 2.0 | 1.0 | 0.5 | 2.5 | Balance | 29.1 | 1.9 | 1.9 | 0.5 | 3.5 | — | — | — | Outside upper limit of graphite content; unable to prepare sample |
| 10 | Balance | Balance | 20.0 | 2.0 | 2.0 | 1.0 | 0.5 | 1.0 | Balance | 19.7 | 2.0 | 2.0 | 0.5 | 2.0 | 13 | 18 | 24 | Outside lower limit of Cr content |
| 11 | Balance | Balance | 25.0 | 2.0 | 2.0 | 1.0 | 0.5 | 1.0 | Balance | 24.6 | 2.0 | 2.0 | 0.5 | 2.0 | 6 | 8 | 11 | |
| 12 | Balance | Balance | 45.0 | 2.0 | 2.0 | 1.0 | 0.5 | 1.0 | Balance | 44.3 | 2.0 | 2.0 | 0.5 | 2.0 | 0 | 1 | 2 | |
| 13 | Balance | Balance | 50.0 | 2.0 | 2.0 | 1.0 | 0.5 | 1.0 | Balance | 49.3 | 2.0 | 2.0 | 0.5 | 2.0 | — | — | — | Outside upper limit of Cr content; unable to prepare sample |
| 14 | Fe—34Cr—2Mo—0.2Ni—2Si—1.2C (Molten material) | | | | | | | | Fe—34Cr—2Mo—0.2Ni—2Si—1.2C | | | | | | 3 | 9 | 31 | Conventional material: high Cr cast steel |

(1) Effects of P in Overall Composition

Figure 3:
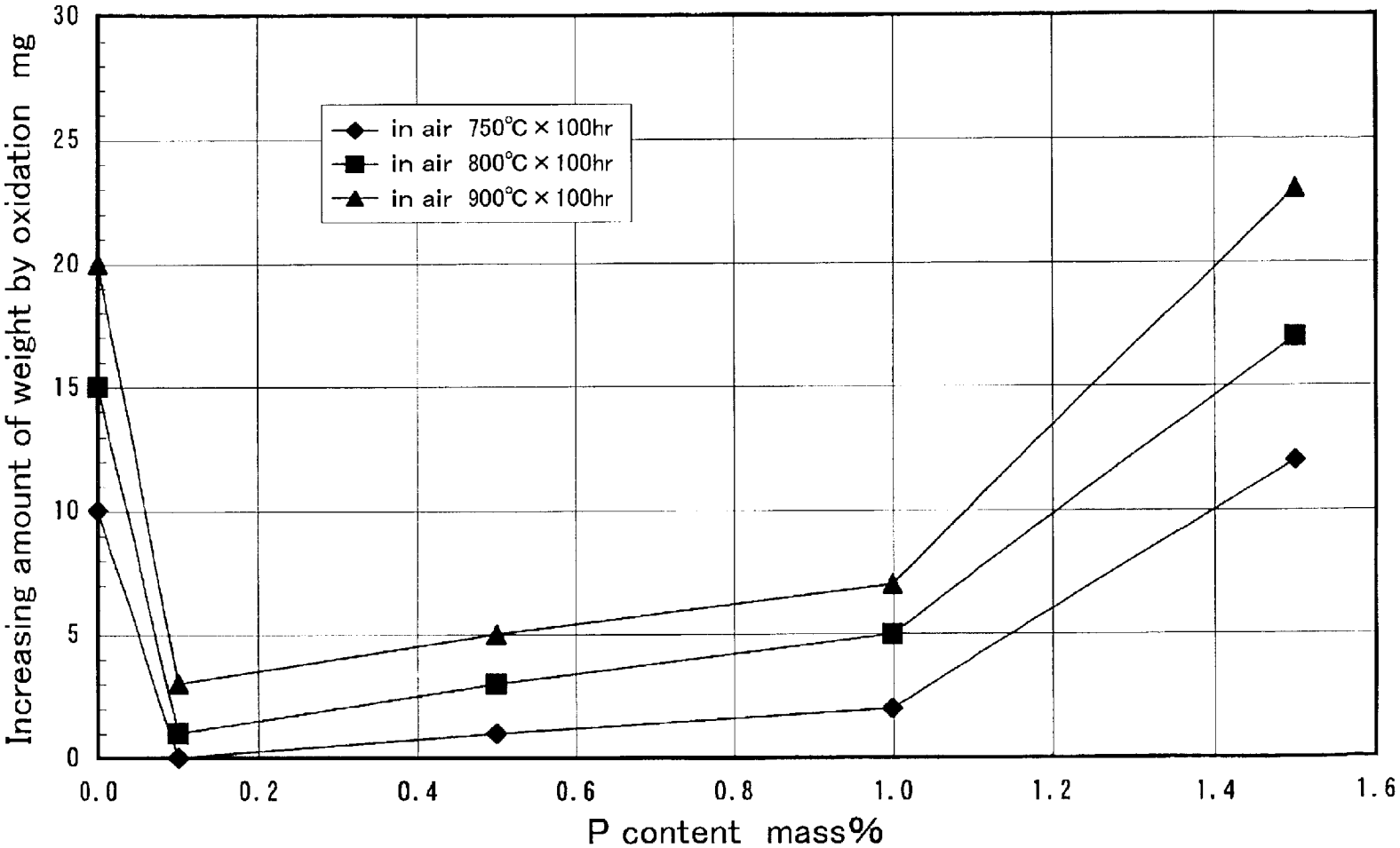
FIG. 3 shows a diagram of the relationships between the P content and increasing amount of weight by oxidation in embodiments of the present invention.

FIG. 3 shows the relationships between the P content in each sample which is mutually different in the P content in the overall composition and increasing amount of weight by oxidation after heating. As is shown in FIG. 3, when the P content is 0.1%, the increasing amount of weight decreases rapidly and oxidation resistance is extremely enhanced. This is a reason that liquid phase formation in sintering is promoted when the P content is 0.1% and pores are decreased to suppress internal oxidation. In contrast, when the P content exceeds 1.0%, the matrix becomes brittle and corrosion resistance is lowered, and thereby the increasing amount of weight is increased.

(2) Effects of Graphite Powder in Mixed Powder

Figure 4:
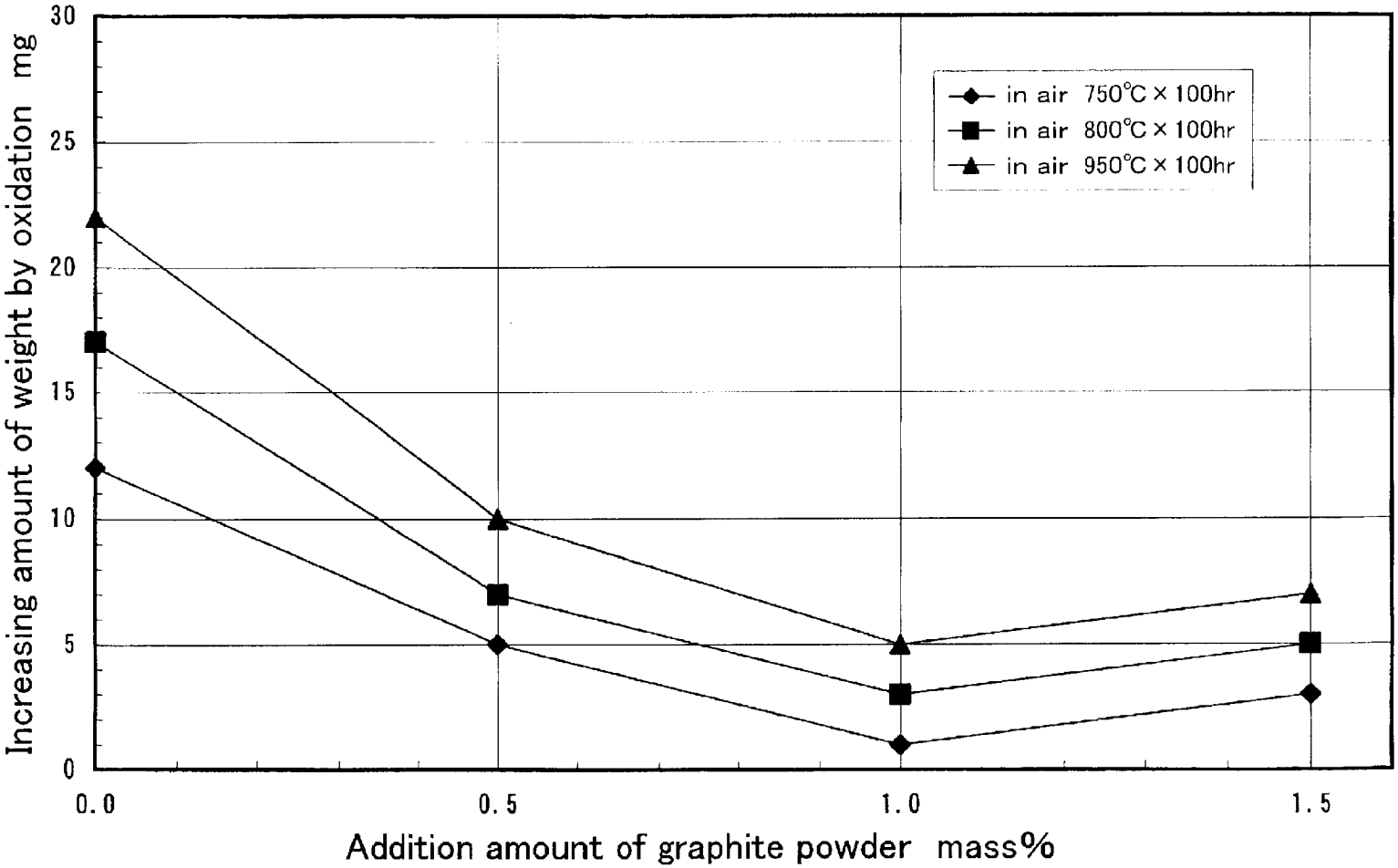
FIG. 4 shows a diagram of the relationships between addition amount of graphite powder and increasing amount of weight by oxidation in embodiments of the present invention.

FIG. 4 shows the relationships between addition amount of graphite powder in each sample which is mutually different in the addition amount of graphite powder in the mixed powder and increasing amount of weight by oxidation after heating. As is shown in FIG. 4, when the addition amount of graphite is in a range of 0.5 to 1.5%, the increasing amount of weight declines. This is a reason that liquid phase formation in sintering is promoted by graphite powder and pores are decreased to suppress internal oxidation.

(3) Effects of Cr in Fe Alloy Powder

Figure 5:
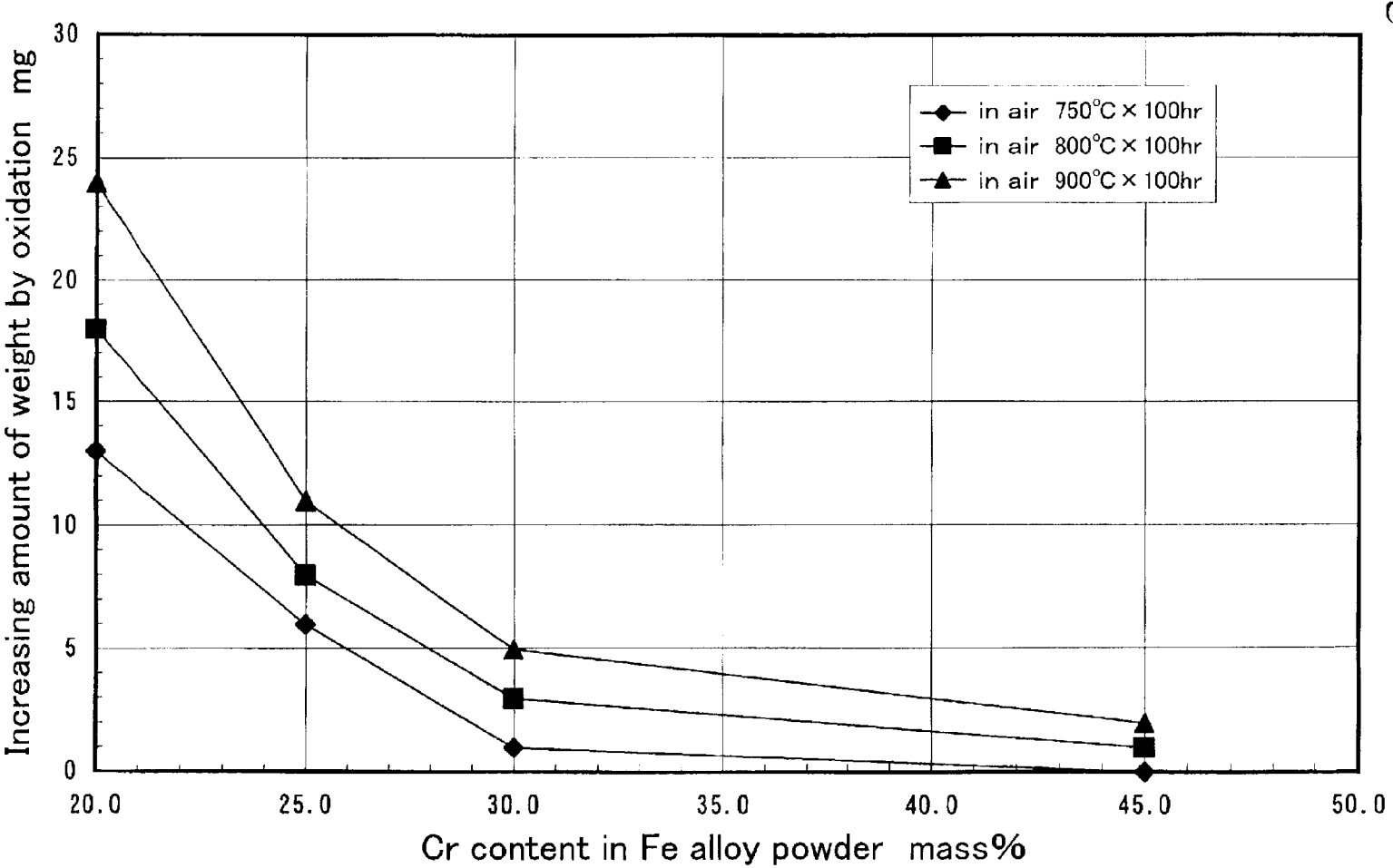
FIG. 5 shows a diagram of the relationships between the Cr content and increasing amount of weight by oxidation in embodiments of the present invention.

FIG. 5 shows the relationships between the Cr content in each sample which is mutually different in the Cr content in the Fe alloy powder and increasing amount of weight by oxidation after heating. As is shown in FIG. 5, the increasing amount of weight is substantially reduced when the Cr content in the Fe alloy powder is 25% or more. This is a reason that heat resistance and corrosion resistance of the matrix are enhanced by Cr.

(4) Comparison with Conventional Material

Figure 6:
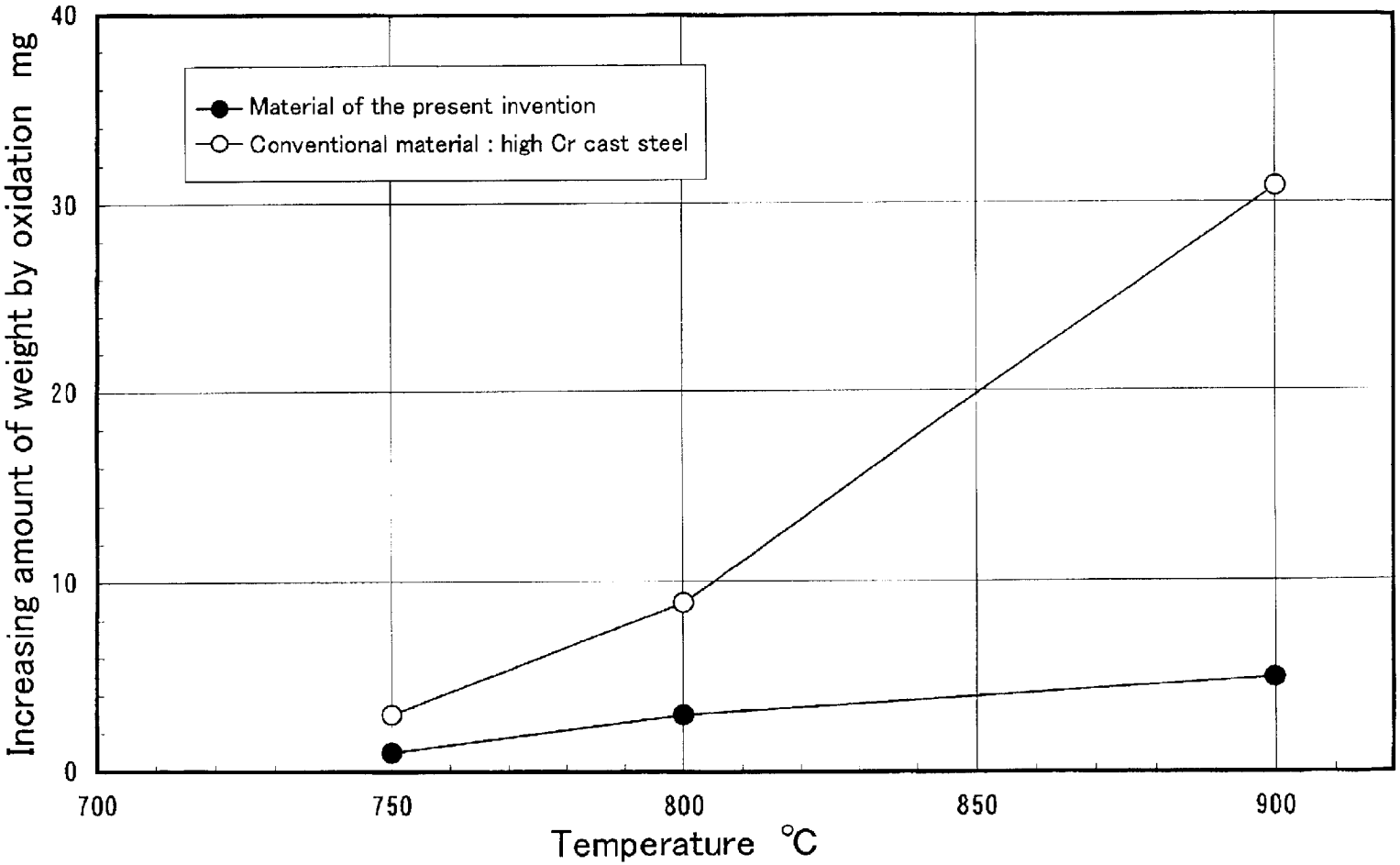
FIG. 6 shows a diagram of the relationships between test temperature and increasing amount of weight by oxidation in materials of the embodiment of the invention and a conventional high Cr cast steel.

FIG. 6 shows a diagram of measuring results of increasing amounts of weight in samples of the invention and a conventional high Cr cast steel (No. 14) after heating to a temperature in the range of 750 to 900° C. in air for 100 hours. As shown in FIG. 6, the material of the present invention is smaller in the increasing amount of weight by oxidation than the conventional material having the density ratio of 100%. As is shown by comparison of metallographic structures of two samples, in the material of the present invention, fine Cr carbide is dispersed in the matrix, whereas in the conventional material, Cr carbide is precipitated in the crystal grain boundaries. It is believed that the material of the invention has superior heat resistance which is higher than that of the conventional material since the Cr carbide is finely dispersed in the matrix.

As explained above, the present invention can provide a turbo component which has equal or higher heat resistance as compared with expensive high Cr cast iron, which exhibits superior corrosion resistance and wear resistance, and which is inexpensive.

What is claimed is:

1. A turbo component for a turbocharger having overall composition, in ratio by mass, of Cr: 23.8 to 44.3%, Mo: 1.0 to 3.0%, Si: 1.0 to 3.0%, P: 0.1 to 1.0%, C: 1.0 to 3.0%, and the balance of Fe and inevitable impurities and Cr carbide is dispersed in the matrix at a density ratio of 95% or more, wherein the turbo component is obtained by steps comprising:

using a mixed powder having 1.0 to 3.3 mass % of Fe—P powder including P: 10 to 30 mass %, and 0.5 to 1.5 mass % of graphite powder, added to Fe alloy powder comprising, in ratio by mass, Cr: 25 to 45%, Mo: 1 to 3%, Si: 1 to 3%, C: 0.5 to 1.5%, and the balance of Fe and inevitable impurities;

forming the mixed powder; and sintering.

2. A turbo component for a turbocharger having overall composition, in ratio by mass, of Cr: 23.8 to 44.3%, Mo: 1.0 to 3.0%, Si: 1.0 to 3.0%, P: 0.1 to 1.0%, C: 1.0 to 3.0%, and the balance of Fe and inevitable impurities, and Cr carbide and Mo carbide are dispersed in the matrix at a density ratio of 95% or more, wherein the turbo component is obtained by steps comprising:

using a mixed powder having 1.0 to 3.3 mass % of Fe—P powder including P: 10 to 30 mass %, and 0.5 to 1.5 mass % of graphite powder, added to Fe alloy powder comprising, in ratio by mass, Cr: 25 to 45%, Mo: 1 to 3%, Si: 1 to 3%, C: 0.5 to 1.5%, and the balance of Fe and inevitable impurities;

forming the mixed powder; and sintering.

* * * * *